US010745933B1

(12) United States Patent
Elliott

(10) Patent No.: US 10,745,933 B1
(45) Date of Patent: Aug. 18, 2020

(54) SIDE WALL APPARATUS

(71) Applicant: Kaywood J Elliott, Grand Falls-Windsor (CA)

(72) Inventor: Kaywood J Elliott, Grand Falls-Windsor (CA)

( * ) Notice: Subject to any disclaimer, the term of this patent is extended or adjusted under 35 U.S.C. 154(b) by 0 days.

(21) Appl. No.: 16/409,789

(22) Filed: May 11, 2019

(51) Int. Cl.
*E04H 15/64* (2006.01)
*E04H 15/30* (2006.01)

(52) U.S. Cl.
CPC ..... *E04H 15/30* (2013.01); *E04H 15/64* (2013.01)

(58) Field of Classification Search
CPC ..... E04H 15/60; E04H 15/64
USPC ..... 160/340, 341
See application file for complete search history.

(56) References Cited

U.S. PATENT DOCUMENTS 721,993 A * 3/1903 Arnett ..... E04H 15/44 135/121
800,111 A * 9/1905 James ..... E06B 9/54 160/25
2,771,088 A * 11/1956 Soldan ..... E04H 15/003 135/87
3,487,842 A * 1/1970 Faeder ..... E04H 15/003 135/121
7,350,556 B2 * 4/2008 Pernicano ..... E04H 15/32 135/120.1
7,913,711 B2 * 3/2011 Milano, Jr. ..... E06B 3/38 135/117
8,997,768 B1 * 4/2015 Bourne ..... E04F 10/0662 135/90
2006/0175019 A1 * 8/2006 Rewak ..... E04F 10/0648 160/67

* cited by examiner

*Primary Examiner* — Noah Chandler Hawk
(74) *Attorney, Agent, or Firm* — Capehart Law Firm

(57) ABSTRACT

A side wall apparatus used with a tent having a canopy and a tent frame having at least two upright poles. The apparatus includes a tent engagement component and a side wall retention component. The tent engagement component is configured to engage the canopy at or above a side wall cable. The side wall retention component includes a tent engagement end, a ground base end and an engagement end and the ground base end. The tent engagement end is rotationally engaged to the tent engagement component.

5 Claims, 8 Drawing Sheets

FIG. 1 – Prior Art

FIG. 2 – Prior Art

SIDE WALL APPARATUS

REFERENCE TO PENDING APPLICATIONS

This application does not claim the benefit of pending application.

BACKGROUND OF THE INVENTION

1. Field of the Invention

The present invention generally relates to a tent having at least one side wall, and more specifically, to an apparatus for installing and tearing down of a side wall used with a tent.

2. Description of the Related Art

Canopy tents may typically have sidewalls for privacy and shelter from the elements. As illustrated in FIGS. 1-2, an example prior art canopy tent 10 with a side wall 20 is illustrated. Tent 10 includes a canopy 12 and a tent frame 14 that provides support for the canopy 12. The tent frame 14 includes four upright poles 15 extending to four upper corners 18, two of which are shown. A horizontal pole 16 extends between each adjacent pair of corners 18 and provides additional support for the tent frame 14. A center pole or a series of additional support bars, not shown, may be utilized to provide additional support to the canopy 12.

The prior art tent 10 also includes a sidewall 20. Sidewall 20 include a plurality of cable clips 24 which are connected to a cable wire 22, otherwise known as a rope line, that extends between each adjacent pair of upright poles 15. For the installation and teardown of the sidewall 20, the sidewall 20 usually require at least two workers working together due to the bulkiness of the sidewall 20 and the set-up process. The set-up process typically requires placing the sidewall 20 on a tarp on the ground 11 prior to installation or after the teardown to unfold or fold up the side wall 20. This process is awkward and time consuming for the workers. Traditionally folding the sidewall causes the sidewall to become dirty and possibly damaged over time, shortening the life span of the side wall and more wages in cleaning the side wall from transfer of dirt.

Thus, there is a need for solution to the above-mentioned disadvantages.

SUMMARY OF THE INVENTION

In one aspect of the present invention, a side wall apparatus used with a tent having a canopy and a tent frame having at least two upright poles. The tent frame supports, and elevates, the canopy above the ground. The tent has a side wall cable extending horizontally between the at least two upright poles proximate the canopy, and at least one side wall being removably secured to the side wall cable.

The inclusion of a tent having only upright poles and a canopy along with a side wall cable is illustrative and not meant to be limiting. Those skilled in the art will recognize that other tent configurations may be utilized with the present invention, for example, a tent having five or more upright poles, a tent having a perimeter frame with horizontal support bars between the upright poles, a tent that does not have a side wall cable and requires the side wall to be secured by other fasteners, such as loop and mesh fasteners.

In this aspect, the apparatus includes a tent engagement component and a side wall retention component. The tent engagement component is designed to engage the canopy at or above the side wall cable.

The side wall retention component has a tent engagement end, a ground base end and a tubular elongated cylindrical body having a longitudinal axis running between the tent engagement end and the ground base end. The tent engagement end engages with the tent engagement component to allow for rotational movement. The ground base end is designed to be located at a portion of the ground below the tent canopy such that the cylindrical body is at an angle relative to vertical of between 15° and 75°. This allows for the side wall retention component to be placed against a side wall such that the side wall is slightly elevated and resting against the body of the side wall retention component. In some aspects, one or more securing clips may be utilized to assist with securing the side wall to the body.

The cylindrical body is configured to rotate about the longitudinal axis allowing one of the at least one side wall to be rolled up thereon or unrolled therefrom. In some aspects, the cylindrical body may rotate relative to the tent engagement end and the ground base end. In some aspects, the entire side wall retention component may rotate related to the tent engagement component. In some aspects, a removable handle may be included to assist in providing rotational movement to the side wall retention component.

In some aspects, the tent engagement component may include a tent engagement body that is configured to engage the canopy at or above the side wall cable and a side wall retention component fitting that is configured to rotationally receive the side wall retention component. In other aspects, the tent may also include a perimeter frame that engages with the tent canopy. The perimeter frame has at least one horizontal support bar. In these aspects, the tent engagement body component may include a curved portion configured to engage the at least one horizontal support bar.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, portable mattress seat, constructed and operative according to the teachings of the present invention.

The various embodiments of the present invention will hereinafter be described in conjunction with the appended drawings, wherein like designations denote like elements.

DETAILED DESCRIPTION

The present invention is generally directed toward a side wall apparatus used with a tent having a canopy elevated above the ground by a tent frame. At least one side wall is secured by cable clips to a side wall cable that extends horizontally along a length of a side of the canopy. The side wall apparatus includes a tent engagement component that is configured to engage the canopy at or above the side wall cable and a side wall retention component that engages the tent engagement component at an angle relative to the ground. The apparatus allows for the rotation of the side wall retention component in order to wrap up, or roll up, the sidewall thereon.

Figure 1:
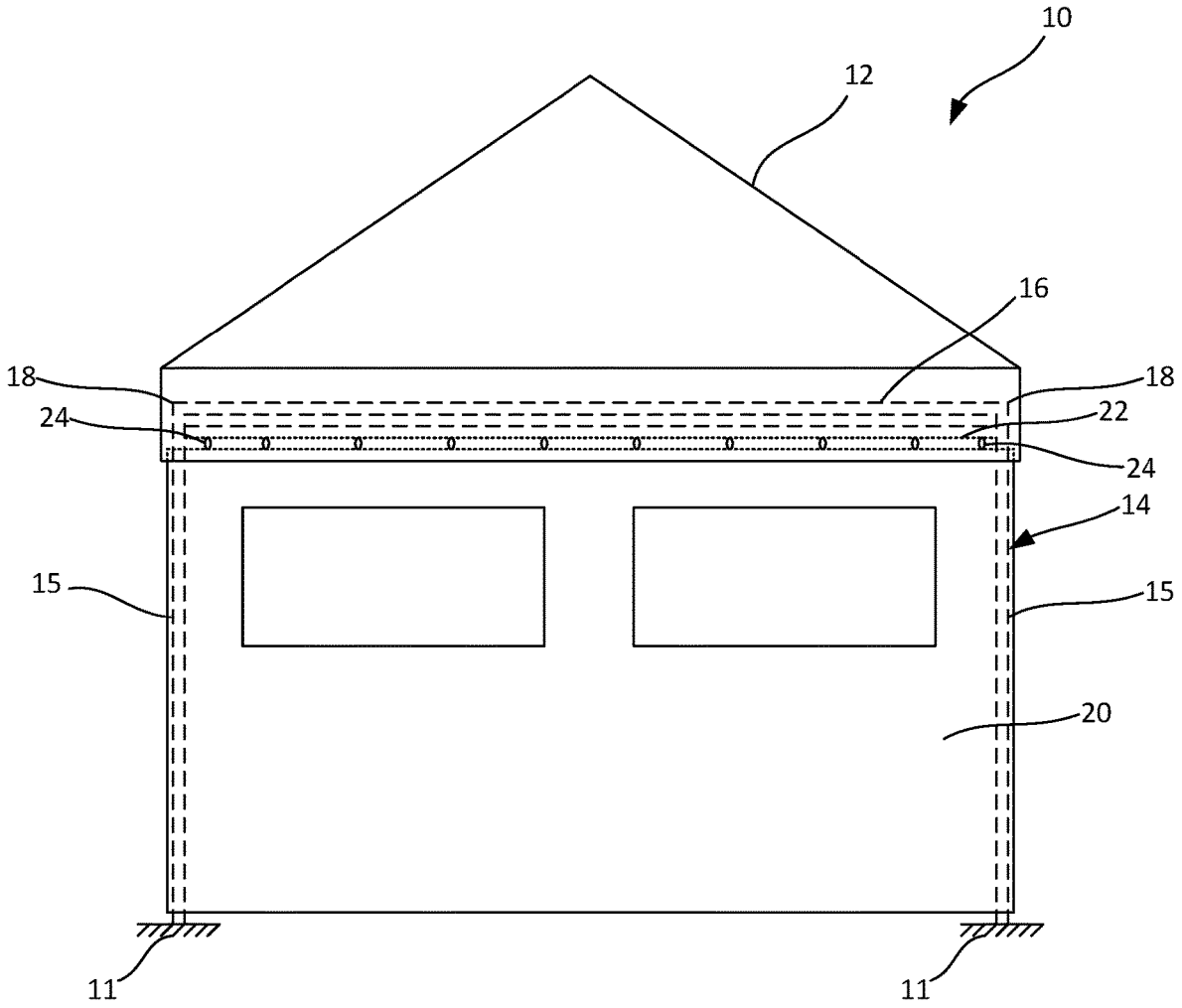
FIG. 1 is a side view of a prior art canopy tent with sidewalls.
Figure 2:
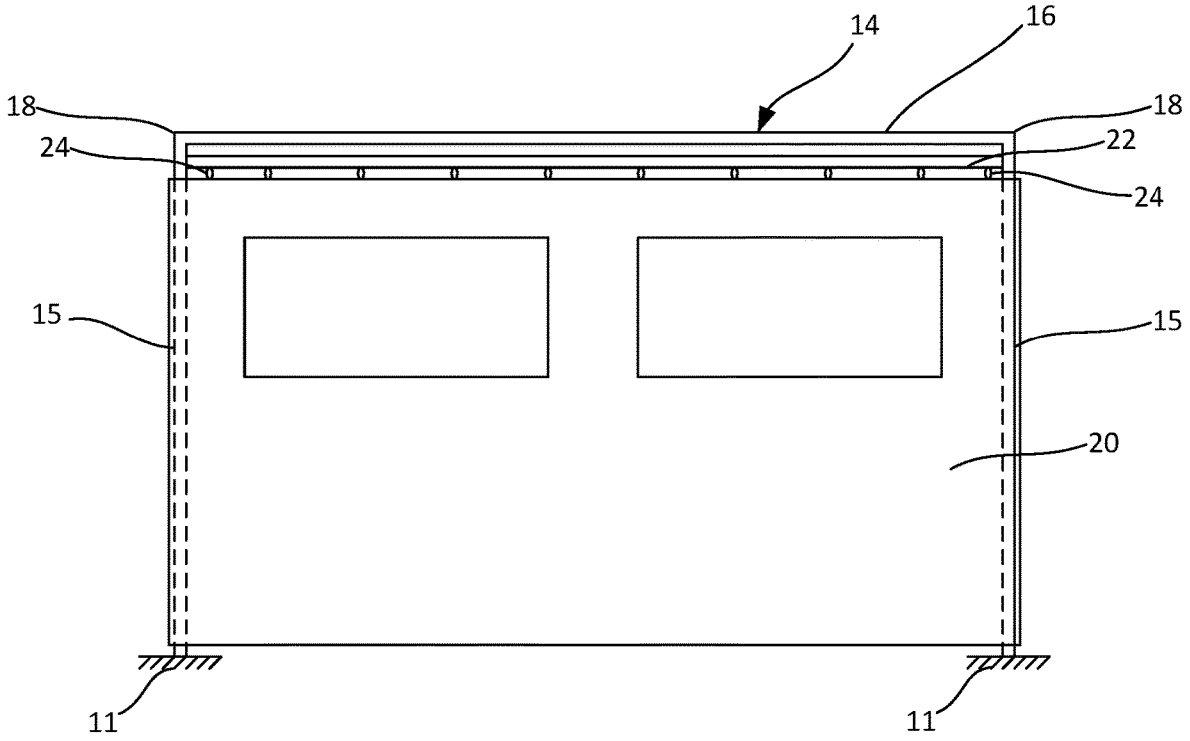
FIG. 2 is a side view of a prior art canopy tent with sidewalls without the canopy.
Figure 3:
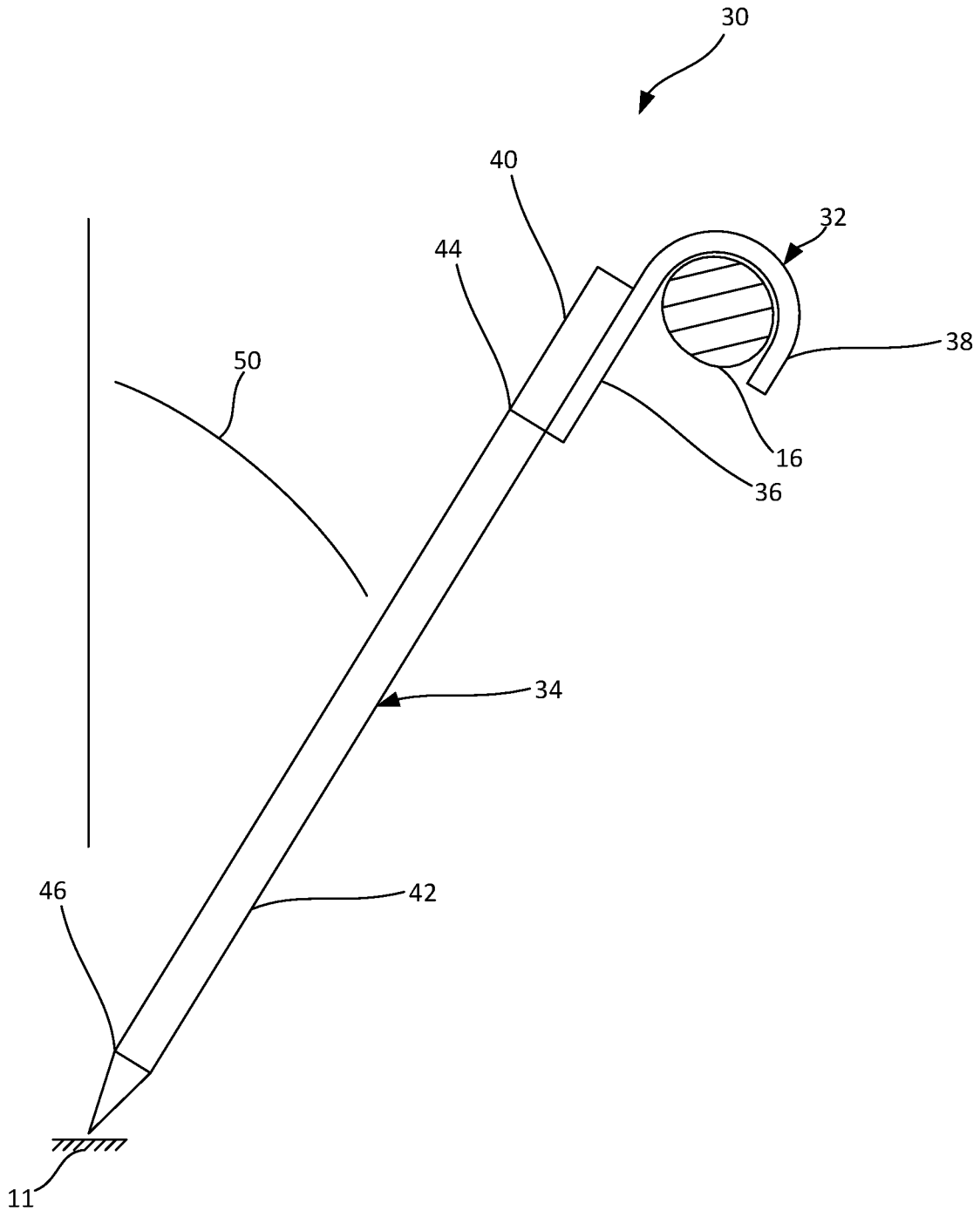
FIG. 3 is a side perspective view of an embodiment of the present invention.
Figure 4:
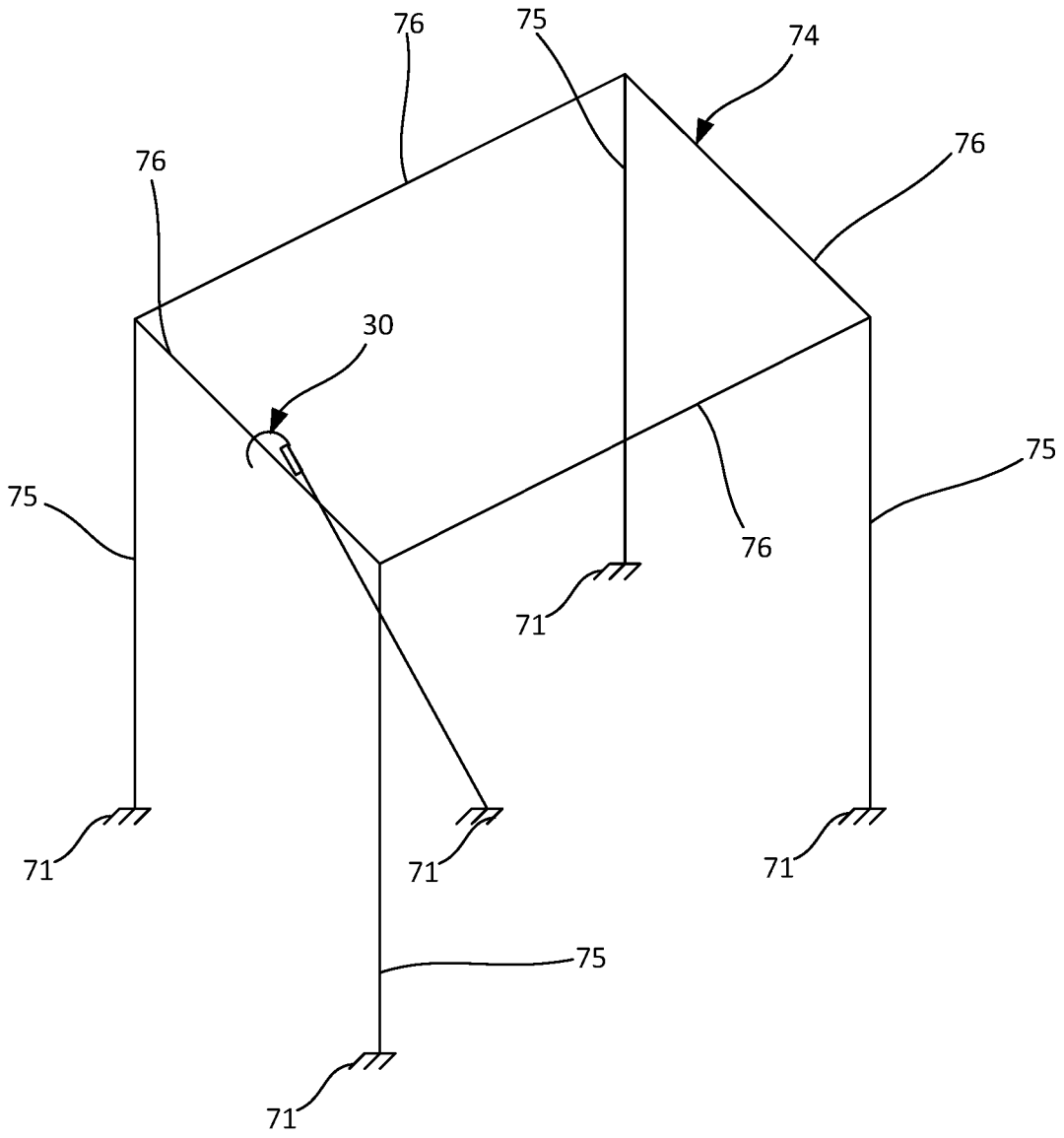
FIG. 4 is a schematic perspective view of an embodiment of the present invention engaged with a tent frame.

As illustrated in FIGS. 3-4, an embodiment of a side wall apparatus 30 of the present invention is disclosed. Side wall apparatus 30 is used with a tent having a canopy elevated above the ground 71 by a tent frame 74 and at least one side wall 70, see FIG. 4. The tent frame 74 includes four upright poles 75 and four horizontal pole 76 extends between each adjacent pair of upright poles 75 and provides additional support for the tent frame 74. In this embodiment, a tent having four-sides and a tent frame is illustrated. This is merely illustrative and not meant to be limiting. Those skilled in the art will recognize that any multi-sided tent having various support poles that utilizes sidewalls is within the scope of the present invention.

An embodiment of the side wall apparatus 30 includes a tent engagement component 32 and a side wall retention component 34 that is rotationally secured to the tent engagement component 32. The tent engagement component 32 is configured to engage a horizontal pole 76. In this embodiment, the tent engagement component 32 includes a tent engagement body 36 having a curved portion 38 that is configured to engage the horizontal pole 76.

The side wall retention component 34 has a tent engagement end 44, a ground base end 46 and a tubular elongated cylindrical body 42 having a longitudinal axis running between the tent engagement end 44 and the ground base end 46. The tent engagement end 44 has a fitting section 48 that is configured to engage with tent engagement component 32.

Ground base end 46 is configured to be located at a portion of the ground 71 below the tent canopy such that the cylindrical body 42 is at an angle relative to vertical of between 15° and 75°, see FIG. 3. The cylindrical body 42 being configured to rotate about the longitudinal axis allowing one of the at least one side wall 20 to be rolled up thereon or unrolled therefrom.

Figure 5:
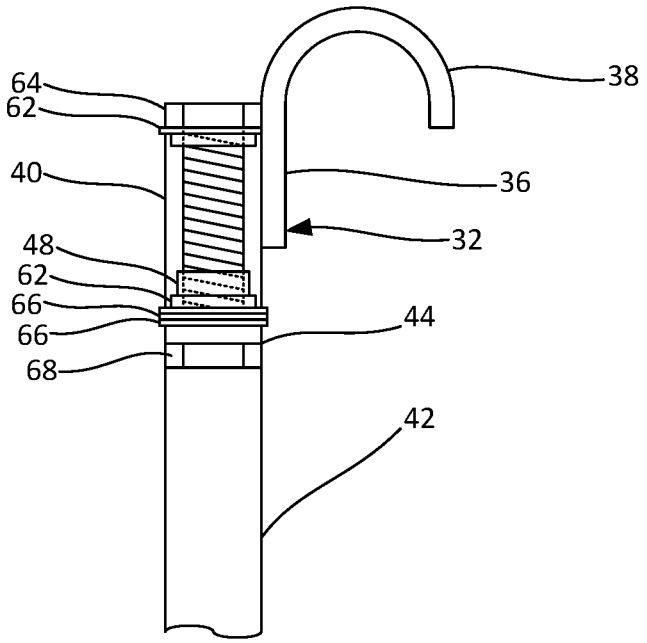
FIG. 5 is a side perspective view of an embodiment of the present invention illustrating the connection between the tent engagement component and the sidewall retention component.

An embodiment of the tent engagement component 32 is illustrated in FIG. 5. Tent engagement component 32 includes a side wall retention component fitting 40 configured to rotationally receive the tent engagement end 44 of the side wall retention component 34. Fitting 40 has flange bearings 62 at both ends. A bolt 64 is fitted through fitting 40 and engages with the fitting section 48. A plurality of washers 66 and nuts 68 are utilized to rotationally secure the tent engagement end 44 to the fitting 40. This is illustrative and not meant to be limiting. Those skilled in the art will recognize that other configurations of the rotational engagement between the tent engagement component 32 with the side wall retention component 34 may be utilized and are within the scope of the present invention.

Figure 6:
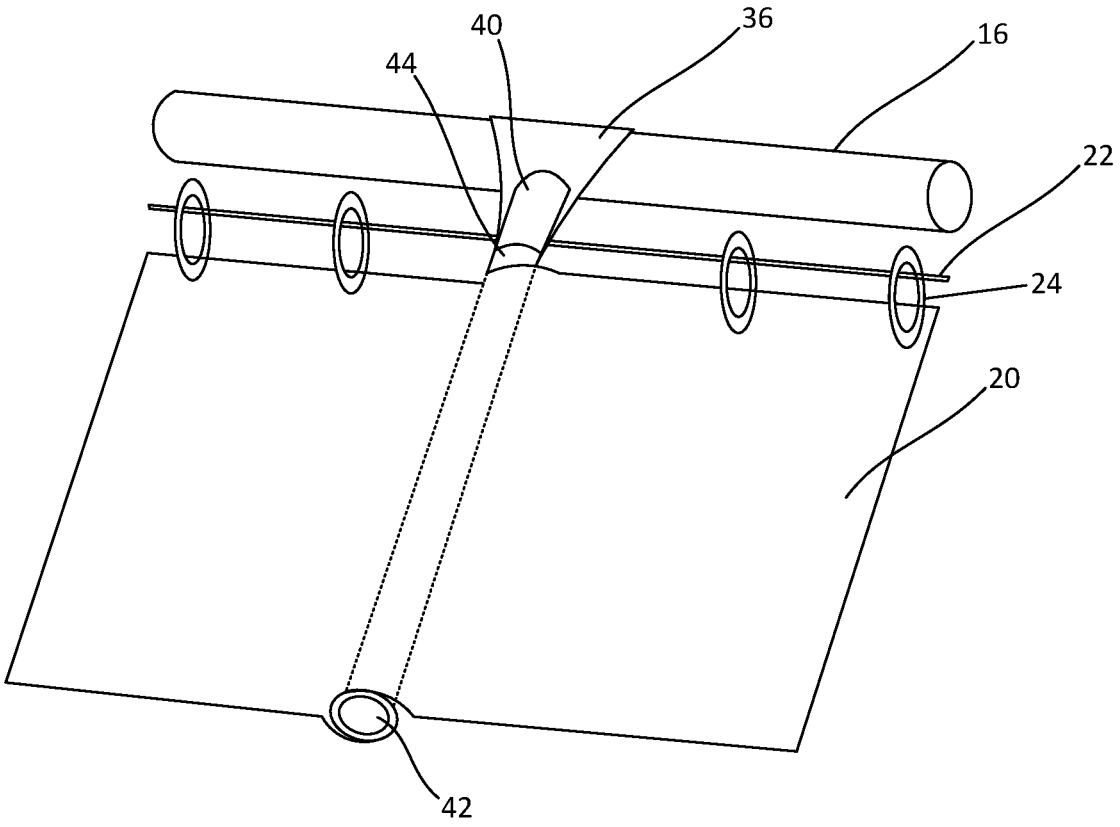
FIG. 6 is a perspective view of an embodiment of the present invention engaged with tent frame and a side wall.

In operation of a typical installation, the side wall 20 is wrapped around the cylindrical body 42, see FIG. 6. As previously disclosed, the curved portion 38 of the tent engagement body 36 is secured to a horizontal pole 16 about the center point of the horizontal pole 16. The ground base end 46 is located at a portion of the ground 11 in the interior of the tent below the tent canopy such that the cylindrical body 42 is at an angle relative to vertical of between 15° and 75°. The sidewall 20 is unwrapped from the cylindrical body 42 by rotating the cylindrical body. As the sidewall 20 is unwrapped, it is secured to the cable wire 22 by the sidewall cable clips 24. The sidewall 20 is therefore installed without the need of being placed on the ground to be unfolded and can be performed by a single worker.

In operation of a typical teardown of the sidewall 20, the cylindrical body 42 is placed against the exterior side of the sidewall 20. The curved portion 38 of the tent engagement body 36 is secured to a horizontal pole 16 about the center point of the horizontal pole 16. The ground base end 46 is located at a portion of the ground 11 in the interior of the tent and below the tent canopy such that the cylindrical body 42 is at an angle relative to vertical of between 15° and 75°.

Figure 7:
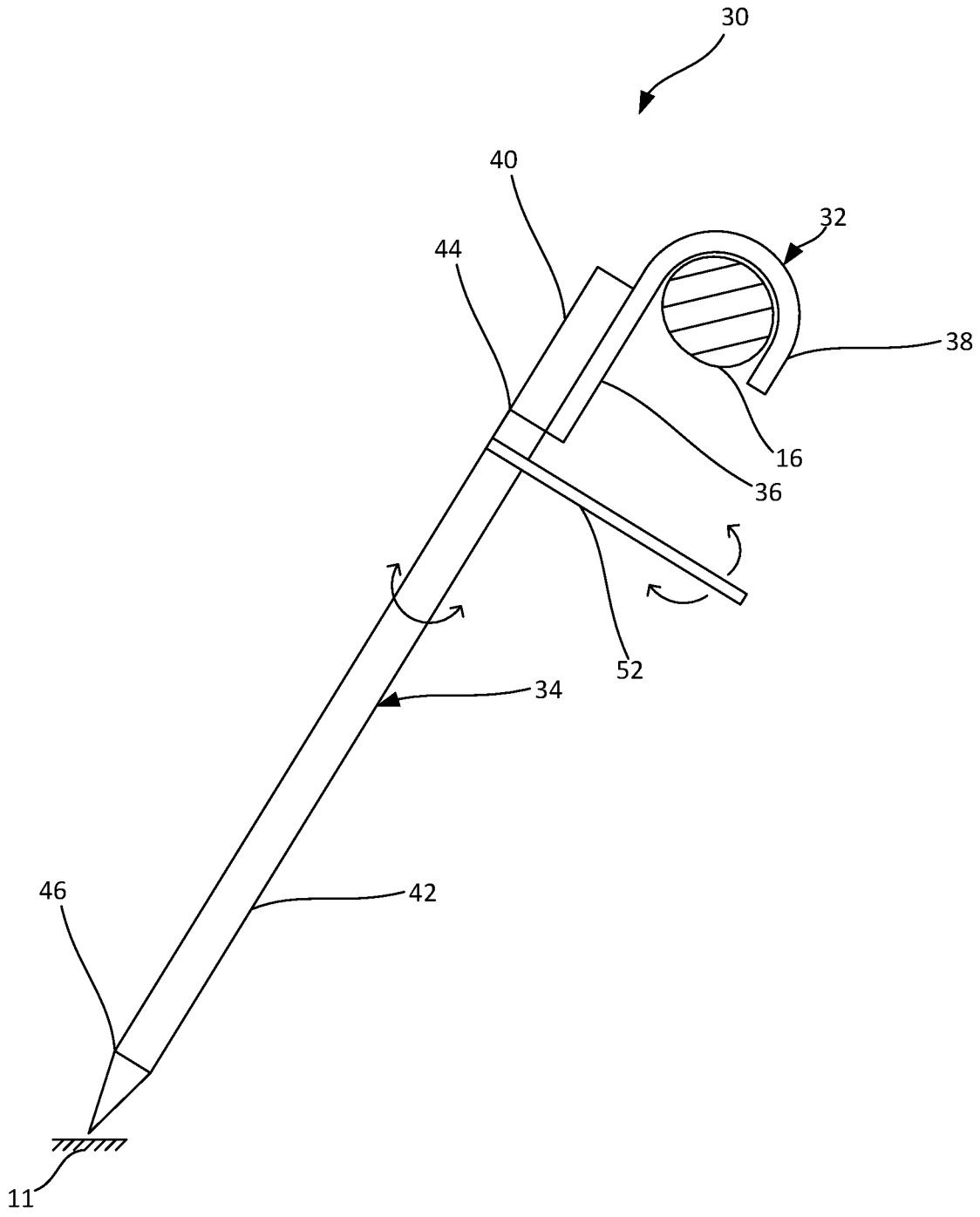
FIG. 7 is a side view of an embodiment of the present invention illustrating an embodiment having a handle.
Figure 8:
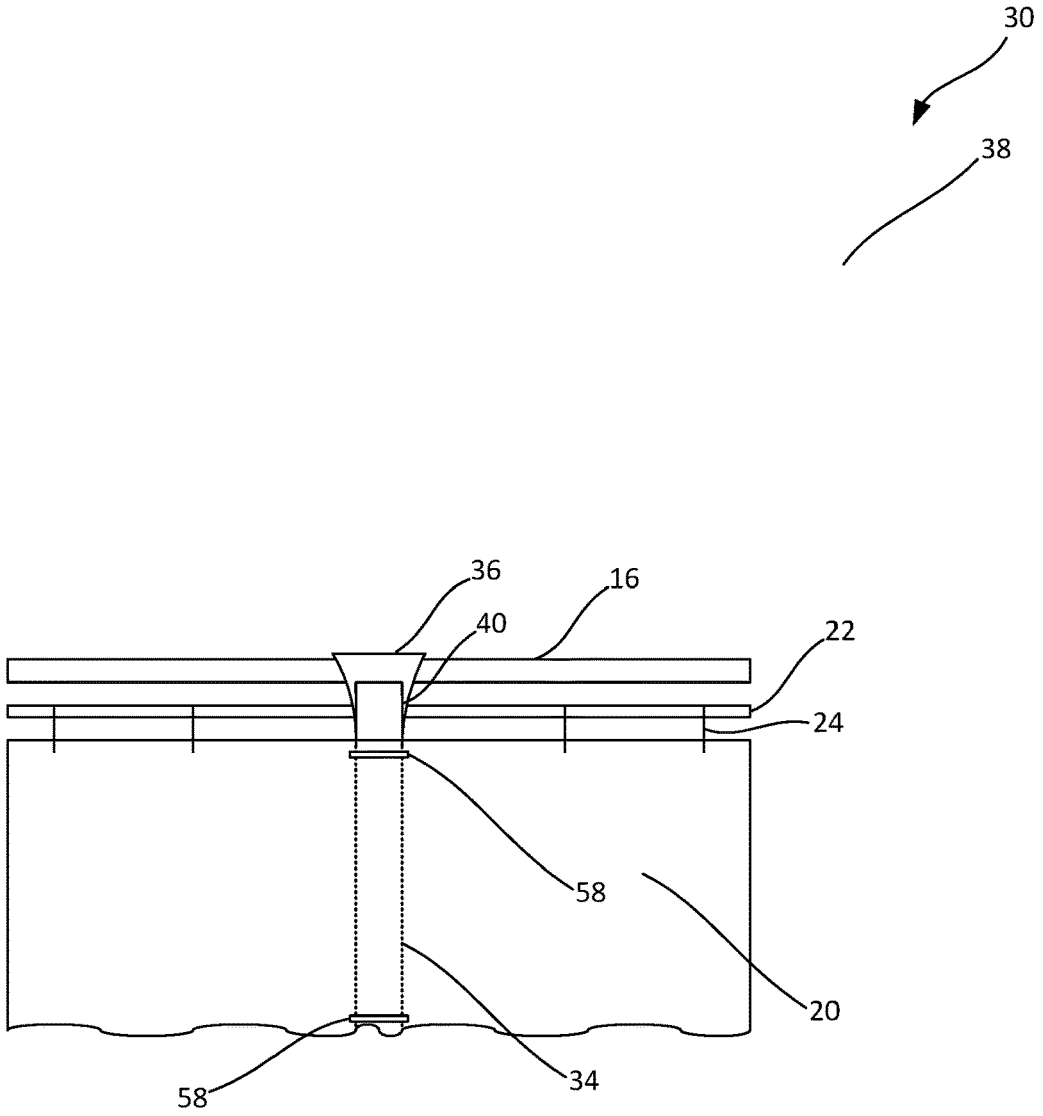
FIG. 8 is a perspective view of an embodiment of the present invention having securing clips engaged with a side wall.

The sidewall 20 is positioned along the cylindrical body 42. In some embodiments, securing clips 58 may be used to secure the sidewall 20 to the cylindrical body 42, see FIG. 8. The sidewall retention component 34 is rotated causing the sidewall to wrap up, or roll-up, on the cylindrical body 42. As the sidewall is being rolled up, the cable clips 24 are removed preventing the sidewall from being placed on the ground and can be performed by a single worker. In some embodiments, the sidewall retention component 34 is rotated by using a handle 52, see FIG. 7.

The exact specifications, materials used, and method of use of the side wall retention apparatus may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

I claim:

1. A side wall apparatus used with a tent having a canopy and a tent frame having at least two upright poles, the tent frame supporting the canopy and elevating the canopy above the ground, the tent having a side wall cable extending horizontally between the at least two upright poles proximate the canopy, the tent having a side wall being removably secured to the side wall cable, the apparatus comprising:

a tent engagement component configured to engage the canopy at or above the side wall cable; and a side wall retention component having a tent engagement end, a ground base end and a tubular elongated cylindrical body having a longitudinal axis running between the tent engagement end and the ground base end, the tent engagement end being rotationally engaged to the tent engagement component, the ground base end configured to be located at a portion of the ground below the tent canopy such that the cylindrical body is at an angle relative to vertical of between 15° and 75°, the cylindrical body being configured to rotate about the longitudinal axis allowing the side wall to be rolled up thereon or unrolled therefrom.

2. The apparatus of claim 1, wherein the tent engagement component comprising:

a tent engagement body configured to engage the canopy at or above the side wall cable; and a side wall retention component fitting configured to rotationally receive the side wall retention component.

3. The apparatus of claim 2, wherein the tent frame is further defined as having at least one horizontal support bar extending between the at least two upright poles proximate the canopy, the tent engagement body component further comprising:

a curved portion configured to engage the at least one horizontal support bar.

4. The apparatus of claim 1, further comprising at least one securing clip configured to secure the side wall to the cylindrical body.

5. The apparatus of claim 1, further comprising a removable handle configured to removably engage the side wall retention component and to provide rotational movement to the side wall retention component.

* * * * *